US010703558B2

(12) United States Patent
Dijkstra

(10) Patent No.: US 10,703,558 B2
(45) Date of Patent: Jul. 7, 2020

(54) PACKAGING UNIT FOR PRODUCTS LIKE EGGS, AND MOULD AND METHOD THERE FOR

(71) Applicant: HUHTAMAKI MOLDED FIBER TECHNOLOGY B.V., Franeker (NL)

(72) Inventor: Wijbe Dijkstra, Franeker (NL)

(73) Assignee: HUHTAMAKI MOLDED FIBER TECHNOLOGY B.V., Franeker (NL)

( * ) Notice: Subject to any disclaimer, the term of this patent is extended or adjusted under 35 U.S.C. 154(b) by 711 days.

(21) Appl. No.: 15/213,948

(22) Filed: Jul. 19, 2016

(65) Prior Publication Data

US 2016/0325919 A1 Nov. 10, 2016

Related U.S. Application Data

(63) Continuation of application No. 14/236,040, filed as application No. PCT/NL2012/050528 on Jul. 23, 2012, now abandoned.

(30) Foreign Application Priority Data

Jul. 29, 2011 (NL) ..... 2007197

(51) Int. Cl.
*B65D 85/32* (2006.01)
*B65B 23/02* (2006.01)
*B65D 25/20* (2006.01)

(52) U.S. Cl.
CPC ..... *B65D 85/324* (2013.01); *B65B 23/02* (2013.01); *B65D 25/205* (2013.01); *B65D 85/32* (2013.01); *B65D 85/321* (2013.01)

(58) Field of Classification Search
CPC .... B65D 85/32; B65D 85/321; B65D 85/322; B65D 52/205; B65D 25/205; B65D 85/324; B65B 23/02
USPC ..... 206/521.1, 459.5, 521.8, 521.15; 220/507
See application file for complete search history.

(56) References Cited

U.S. PATENT DOCUMENTS

| | | | |
|---|---|---|---|
| 2,600,130 | A | 6/1952 | Schilling |
| 3,090,539 | A | 5/1963 | Dorofachuk |
| 3,346,171 | A | 10/1967 | Baker |
| 3,396,895 | A | 8/1968 | Pearl et al. |
| 3,790,063 | A | 2/1974 | Moller |
| 3,813,027 | A | 5/1974 | Misdom, Jr. et al. |
| 4,059,219 | A | 11/1977 | Reifers et al. |
| 4,617,748 | A | 10/1986 | Padovani |
| 4,795,080 | A | 1/1989 | McIntyre |

(Continued)

FOREIGN PATENT DOCUMENTS

| | | | |
|---|---|---|---|
| EP | 1153850 | A1 | 11/2001 |
| WO | 2005085095 | A1 | 9/2005 |

OTHER PUBLICATIONS

International Search Report dated Nov. 20, 2012 for PCT/NL2012/050528 filed Jul. 23, 2012. pp. 1-8.

*Primary Examiner* — Steven A. Reynolds
(74) *Attorney, Agent, or Firm* — Dinsmore & Shohl LLP

(57) ABSTRACT

Packaging units for products like eggs, and a mould and method therefore, are disclosed. According to one embodiment a packaging unit for products like eggs includes a carton made of moulded pulp with a bottom part including compartments for individual products, and a cover part including top, front and rear surfaces, and a label made of paperboard.

22 Claims, 6 Drawing Sheets

(56) References Cited

U.S. PATENT DOCUMENTS

| | | | | |
|---|---|---|---|---|
| 5,282,534 | A | 2/1994 | Lapp | |
| 2010/0187150 | A1* | 7/2010 | Dijkstra | B65D 85/324<br>206/521.1 |

* cited by examiner

PACKAGING UNIT FOR PRODUCTS LIKE EGGS, AND MOULD AND METHOD THERE FOR

CROSS REFERENCE TO RELATED APPLICATIONS

The present specification is a continuation of U.S. patent application Ser. No. 14/236,040 filed May 12, 2014 and entitled "Packaging unit for products like eggs, and mould and method there for" which is a U.S. National Phase filing of International Application No. PCT/NL2012/050528, filed on Jul. 23, 2012, designating the United States of America and claiming priority to and the benefit of NL 2007197, filed Jul. 29, 2011. The present application claims the priority to and the benefit of the above-identified applications, and the above-identified applications are incorporated by reference herein in their entirety.

BACKGROUND

Field

The present invention relates to a packaging unit for products like eggs and similar products like kiwis and tomatoes, for example.

Technical Background

Egg cases or cartons known in practice are generally fabricated from carton made of moulded pulp from paper material. Such units comprise a bottom part provided with compartments for individual products, and a cover part that is often hingedly connected to the bottom part. Products like eggs are transported in these units and displayed on shelves in supermarkets, for example. Providing stacks of units with eggs leads to ridging problems. These ridging problems are even increased further due to the increasing stack height that is used in practice.

SUMMARY

The present invention has for its object to obviate or at least reduce the above stated problems with the known egg cases or cartons.

The present invention provides for this purpose a packaging unit for products like eggs, the packaging unit according to the invention comprising:

- a carton made of moulded pulp with a bottom part comprising compartments for individual products and a cover part comprising top, front and rear surfaces; and
- a label made of paperboard.

Using a label made of paperboard achieves an increased strength and stability for the unit without requiring modifications for the carton made of moulded pulp of paper material. This paperboard is defined for the purpose of the present invention as having a weight per surface area above 179 g/m$^2$, preferably above 250 g/m$^2$. The combination of the carton and the label made of paperboard enables an effective transport and display of products like eggs, and/or other perishable products like kiwis and tomatoes reducing ridging problems.

Additional advantages of the packaging unit according to the present invention include the (optional) provision of 3D-effects in the label, for example by embossing. In addition, the paperboard label can be cut, folded, laminated and/or printed. Preferably, the label has a thickness of more than 0.25 mm, more preferably more than 0.3 mm.

In a presently preferred embodiment of the packaging unit according to the invention, the paperboard comprises folding carton.

Preferably, the weight of the folding carton lies between 200 and 600 g/m$^2$. In alternative embodiments, the paperboard comprises (mini) corrugated carton, for example. The use of folding carton provides additional strength and stability to the packaging unit without requiring a significant increase in stacking height.

Preferably, the label is attached to at least the top surface of the cover part with the cover part preferably hingedly connected to the bottom part. This ensures a good visibility of the label for consumers. Also, by attaching the label to at least the top surface of the cover part the distribution of forces and loads acting on the cover part over the entire packaging unit is improved. This improves the overall stability of the unit. Preferably, the label is attached to essentially the entire top surface of the cover part thereby further improving the distribution of the forces and loads. These forces and loads may result from stacking packaging units, for example.

In an advantageous preferred embodiment according to the present invention, the cover comprises openings such that the back side of the label is visible and readable from the inside of the cover part.

The openings in the cover part, especially openings in the top surface of the cover part, form "windows" such that the back side of the label can be read from the inside of the cover part. This prevents providing an additional label or print on the inside of the cover part. Such additional label may comprise information relating to the contents of the products in the packaging unit and production and/or packaging dates.

An additional advantage of providing openings in the cover part is that the amount of material required for the cover part, and especially the top surface thereof, is reduced. By carefully selecting the position of these openings the strength and stability of the packaging unit can be maintained. In fact, in combination with the label according to the present invention, the strength and stability of the packaging unit as a whole is even increased. By requiring less material for the cover part, the packaging unit according to the present invention is relatively cost effective. In an alternative embodiment no text is printed on the back side of the label and, instead, the label is transparent such that consumers may inspect the products visually without opening the packaging unit.

In an advantageously preferred embodiment according to the present invention the cover part comprises an indent such that the support of the front surface of the packaging unit is improved.

Providing an indent in the cover part, more specifically on the edge where the top surface and the front surface of the cover part meet each other, achieves an increased stability for the packaging unit according to the invention. More specifically, the stability is increased in the manufacturing process of the packaging unit. A problem when manufacturing packaging units is the removal of the moulded fibre material from the mould when the material is still wet. In this wet phase sides and/or the front of the packaging unit may collapse, for example. By providing an indent in the cover part the height of the front of the cover part is reduced and the stability of the cover is increased. Therefore, the risk of collapsing of this surface is significantly reduced.

Preferably, the indent is egg shaped. Providing an egg shaped indent achieves an improved load distribution and/or transmission of forces. This reduces the peak loads that may act on the packaging unit. An additional advantage is the visual appearance of the packaging unit in case the packaging unit according to the present invention is used for eggs, for example. Preferably, the indent is used in combination with the label made of folding carton with the label having a top surface and a front surface, thereby contributing to the transmission of forces and reduction of peak loads.

In a further advantageous preferred embodiment of the present invention, the label comprises an extended front surface.

By providing an extended front surface for the label the front surface of the cover part can be reduced. This provides the above mentioned advantages when manufacturing the packaging unit in the wet phase by reducing the risk of collapsing of the front surface of the cover part. An additional advantage of providing an extended front surface is the overall visual appearance, especially when the packaging unit is displayed on a shelf of a supermarket.

Preferably, the extended front surface comprises a folding line. Such folding line can be provided in a relatively straightforward manner when the label is made of folding carton. By providing a folding line the controllability of processing of the packaging unit is improved as the front surface is more flexible. For example, this would be beneficial in a grading and packing machine or line, especially for denesting the packaging units. In addition, the packaging units are provided with a label comprising an extended front surface can be put in an outer box in a similar manner as conventional packaging units thereby using outer boxes of similar dimensions.

Preferably, the extended front surface comprises a groove, opening or notch corresponding to a projection provided on the bottom part such that a lock is achieved. Providing the groove, opening or notch in the front surface of the label achieves a lock in combination with a projection that is provided on the bottom part of the unit. This projection can be shaped like a nock, edge, etc. Providing at least part of the locking mechanism in the extended front surface of the label simplifies the manufacturing of the packaging unit, especially the front surface of the cover part thereof. By providing the label from folding carton an effective lock can be achieved. A further advantage can be achieved if the closing flap on the moulded fiber bottom part can be omitted by providing the label as an effective lock. This reduces weight of the packaging unit. Also, the dimensions of the packaging unit are reduced thereby reducing transport volume.

In a further advantageous preferred embodiment according to the present invention, the top surface of the cover part comprises enforcing ribs.

Providing enforcing ribs on especially the inner side of the top surface of the cover part improves the distribution of forces and loads over the packaging unit. For example when stacking a number of packaging units, the loads and especially the peak loads can be relatively high. These peak loads may result in ridging problems. These ridging problems include dents, dimples and other deformations. In practice these deformations provide a type of wave pattern on the top surface of the cover part. In fact, due to peak loads an undesired print of the bottom of a packaging unit is made on the top surface of a packaging unit placed directly below. By providing the enforcing ribs such ridging problems are prevented or at least reduced. In addition, providing the ribs improves the stability of the packaging units.

Preferably, the enforcing ribs are provided on a location of the cover part such that the ribs engage support cones of the bottom part in a closed position of the unit. The packaging unit is subjected to forces and loads especially in a closed position. By providing the ribs in a location such that the ribs engage the support cones of the bottom part in a closed position of the packaging unit the distribution of forces and loads is improved even further. This significantly increases the strength and stability of the packaging units according to the invention.

In addition, or as an alternative, the enforcing ribs are provided at or on the inner side of the cover part, preferably around each product position. This increases the stability of the packaging unit. An embodiment with ribs around a product position would enable the provision of individual windows in the cover part and label for a single product. This increases the visibility of the product for consumers, for example.

Advantageously, the enforcing ribs also contribute to denesting packaging units.

In a presently preferred embodiment at least part of the enforcing ribs is formed by a label part. Providing enforcing ribs from a label part prevents the use of additional material and, therefore, results in effective packaging units. Preferably the enforcing ribs are made from folding carton. Alternatively, the enforcing ribs are made from (micro) corrugated cardboard.

In a further advantageous preferred embodiment according to the present invention, the cover part comprises denest nocks.

Providing denest nocks in the cover part improves the ease of use of the packaging unit when denesting these units. The use of the denest nocks is improved as the combination with the label according to the present invention prevents introduction of ridging problems as occurs in conventional packaging units.

The present invention further relates to a mould for packaging units as described above.

Such a mould provides the same effects and advantages as described in respect of the packaging unit. An additional advantage of the packaging unit according to the present invention is that the mould can be designed such that further changes or modification to the machinery are prevented. This results in a flexible manufacturing process of the packaging unit according to the present invention.

The present invention further also relates to a method for packing products, comprising the step of providing a packaging unit as described above.

Such a method provides the same effects and advantages as described in respect of the packaging unit and/or mould. In fact, the mould can be used for a large number of different embodiments of the packaging unit according to the invention. This improves the overall efficiency of the manufacturing process.

BRIEF DESCRIPTION OF THE DRAWINGS

Further advantages, features and details of the invention are elucidated on the basis of preferred embodiments thereof, wherein reference is made to the accompanying drawings, in which.

DETAILED DESCRIPTION

Figure 1:
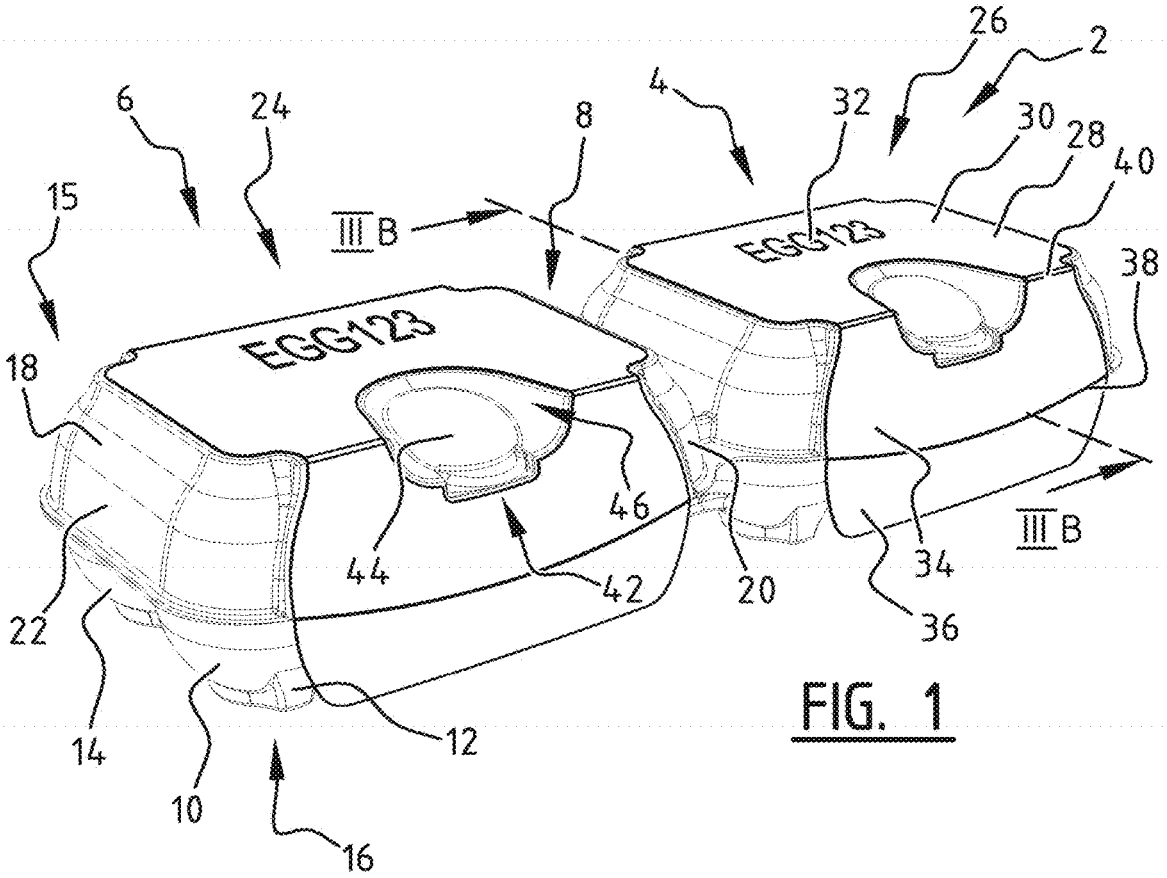
FIG. 1 shows a hybrid pack embodiment of the packaging unit according to the invention in a closed position.

A hybrid pack 2 (FIG. 1) comprises a first packaging unit 4 and a second packaging unit 6 according to the invention. First and second packaging units 4, 6 are connected with a bridging part 8. Bottom part 10 comprises a front surface 12, two side surfaces 14, a back side 15, and a bottom side 16. Cover part 18 is hingedly connected to bottom part 10 and comprises a front surface 20, two side surfaces 22, a back side surface 24 and a top surface 26. Packaging units 4, 6 are provided with a label 28 that is provided with a top surface 30 on which text 32 is printed. In the illustrated embodiment label 28 is provided with a front surface 34, and an extended part 36 for front side 34. Extended part 36 and front surface 34 are connected with folding line 38. Edge 40 defines the transition between top surface 30 and front surface 34. Packaging units 4, 6 are provided with an indent 42 having an egg-shape 44. In the illustrated embodiments label 28 is provided with corresponding cut-out 46.

Figure 2:
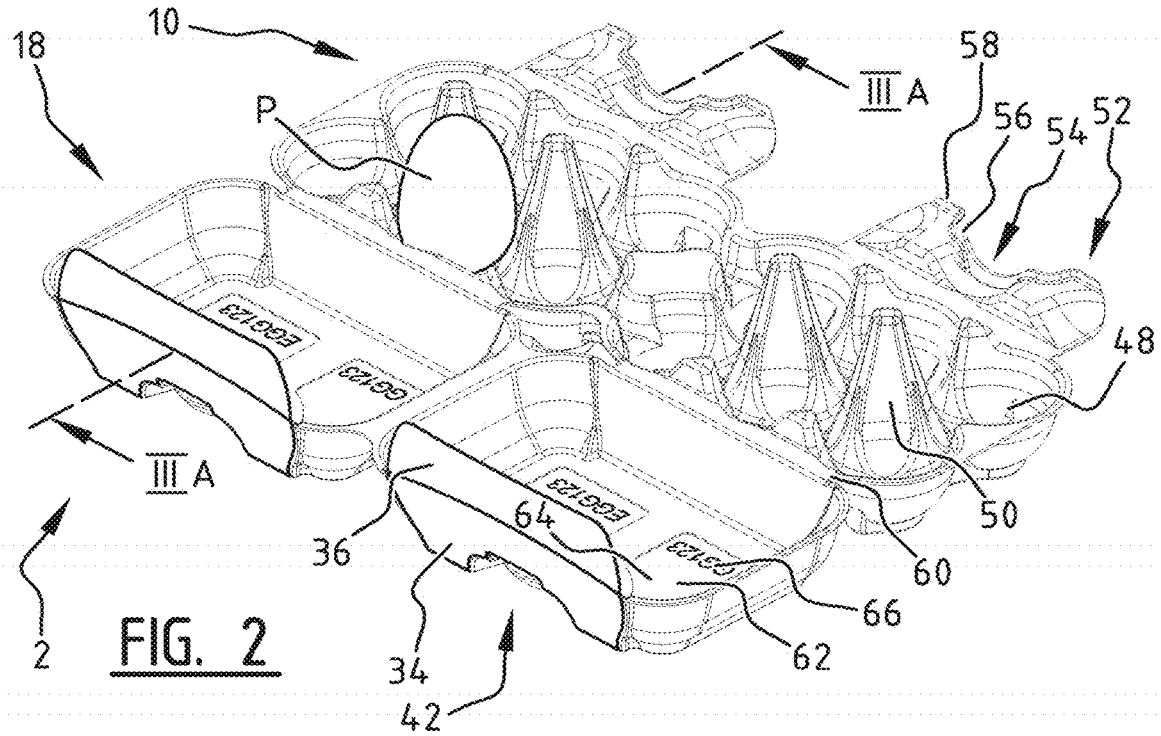
FIG. 2 shows the packaging unit of FIG. 1 in an open position.

On the inside of bottom part 10 (FIG. 2) compartments 48 are provided having contours matching at least partially the outer contours of eggs P. Support cones 50 are provided to add stability and strength to packaging units 4, 6. Lip 52 is hingedly connected to front surface 12 of bottom part 10 and is provided with a cut-out 54. Along the edge of cut-out 54 there is provided a support edge 56 for distributing loads. In addition, a support nock 58 is provided. Cover part 18 and bottom part 10 are hingedly connected via hinge 60. Cover part 18 is provided with a window opening 62 through which the back side 64 of label 28 is visible. In the illustrated embodiment back side 64 of label 28 is provided with text and/or images 66. Alternatively, label 28 is provided with transparent material for window opening 62.

Figure 3A:
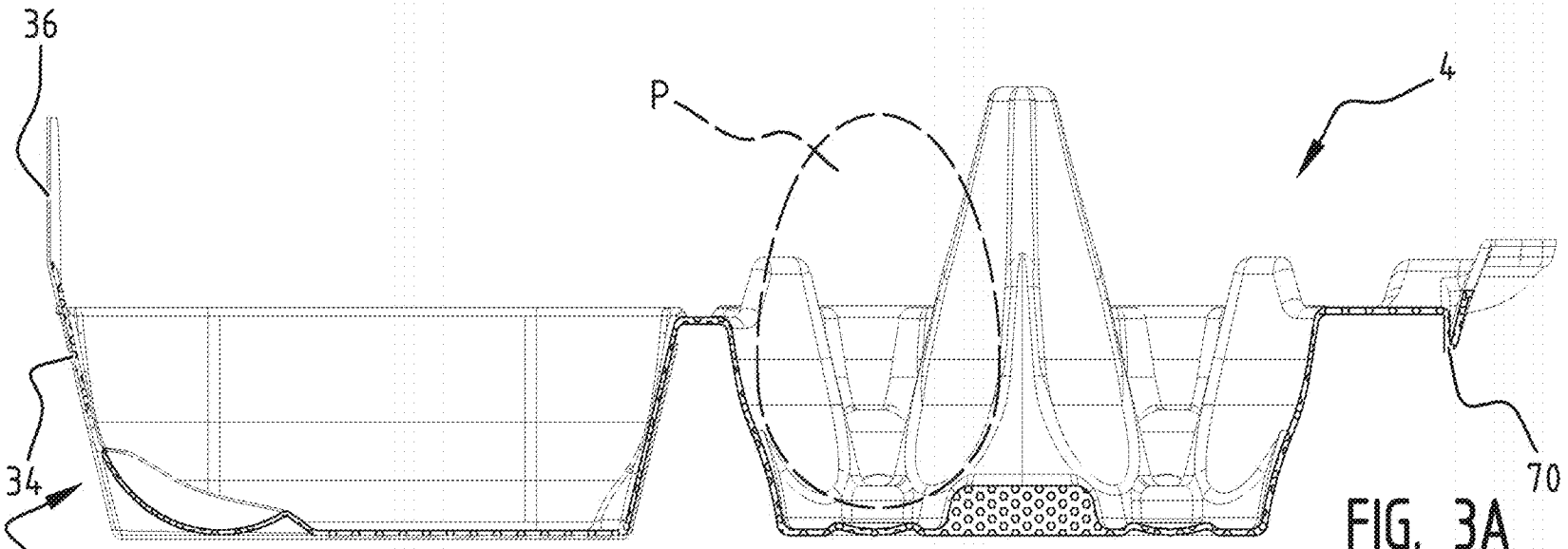
FIGS. 3A and 3B show a cross-sectional view of the packaging unit of FIGS. 1 and 2.
Figure 3B:
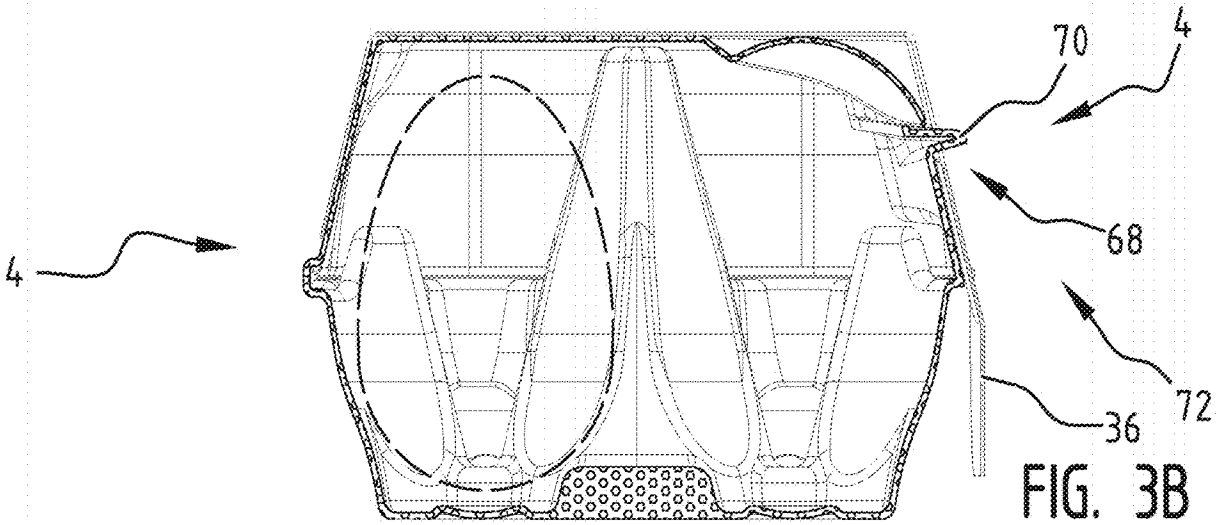

Front 20 of cover part 18 is provided with edge, protrusion, or projection 70 (FIGS. 3A and B) that fits in notch 68 that is provided in front surface 34 of label 28 together providing lock 72 that can be provided in the label and/or the moulded fiber material.

Figure 4:
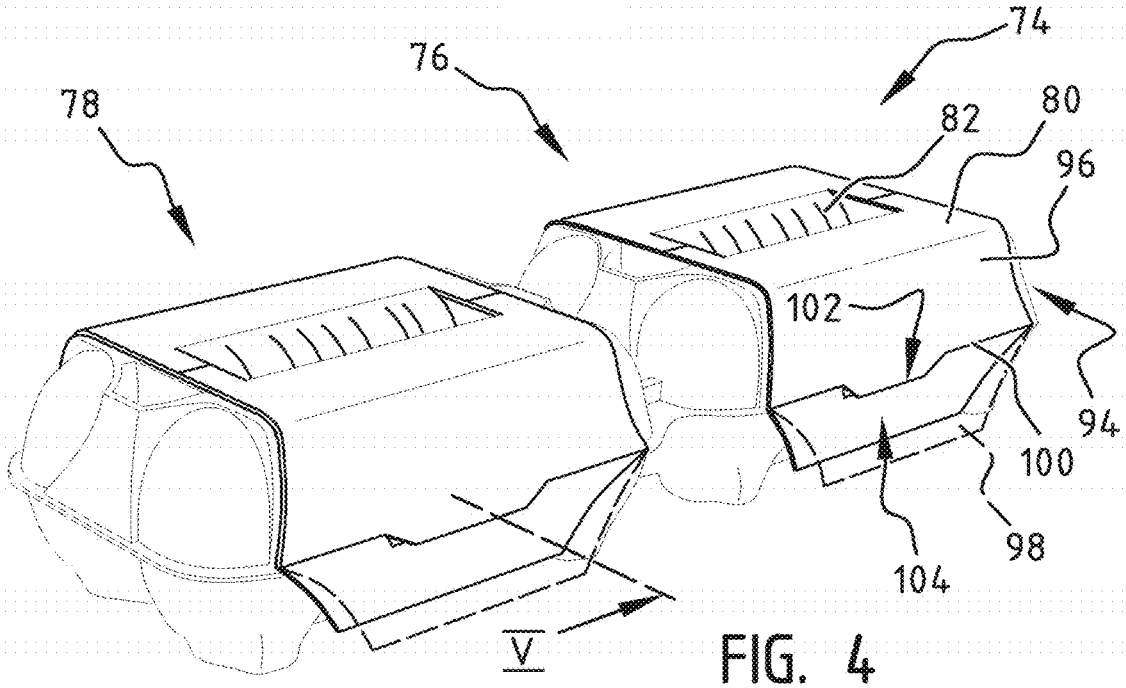
FIGS. 4 and 5A show a packaging unit with an enforcing rib.
Figure 5A:
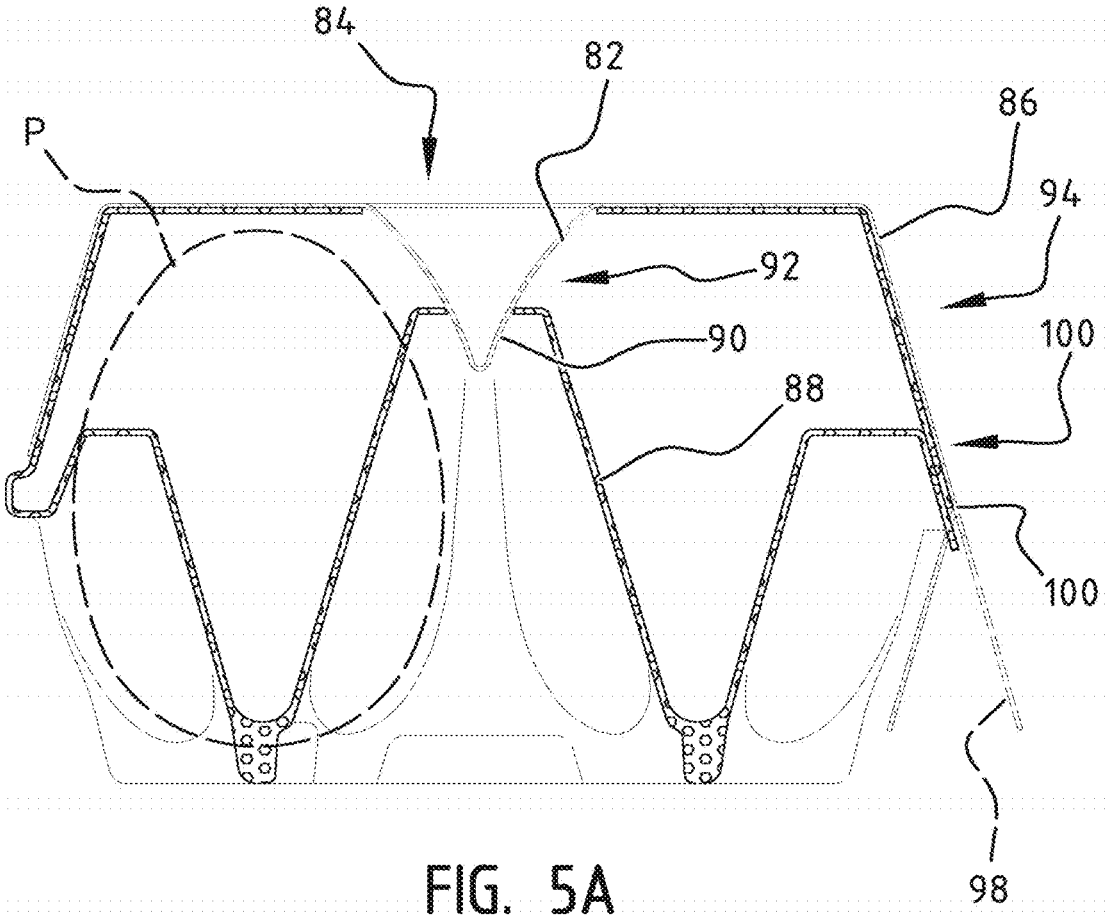
Figure 5B:
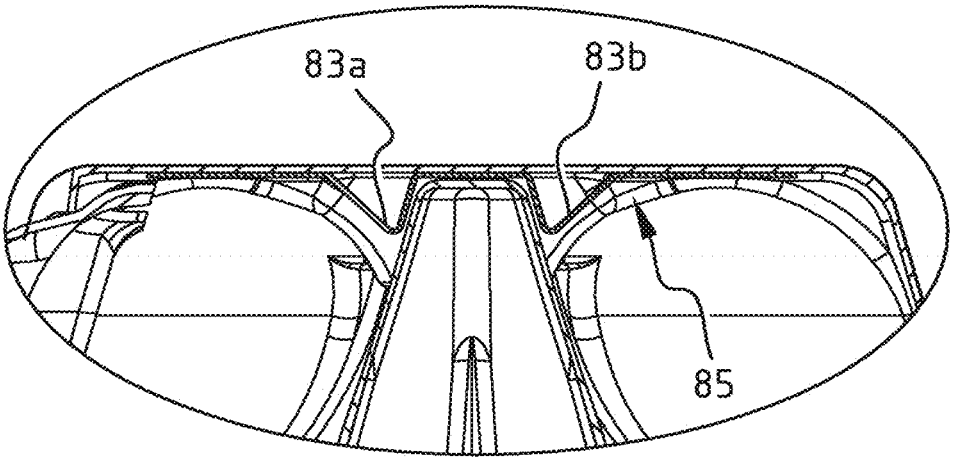
FIG. 5B shows an alternative embodiment with enforcing ribs.

Hybrid pack 74 (FIGS. 4 and 5A) comprises a first unit 76 and a second unit 78. Label 80 provides enforcing rib 82. In a closed position rib 82 is located in an opening 84 in cover part 86 and engages support cone 88. Rib 82 can be provided with text and/or images. In an alternative embodiment two ribs 83*a*, 83*b* (FIG. 5B) are provided on a profiled inside label 85. Providing two ribs 83*a*, 83*b* additionally has a centring function such that the overall stability in a closed position of the packaging unit is improved. It is noted that also hybrid pack 74 can be provided with two ribs 82 (not shown) thereby also providing the above centring function. A profiled inside label 85 with one, two, or more ribs 83*a*, 83*b* can also be applied to conventional packaging units.

In the illustrated embodiment top 90 of rib 82 engages opening 92 provided in the top surface of support cone 88. This provides additional support for cover 86 thereby protecting products P in hybrid pack 74. Label 80 has a front surface 94 that is provided with an upper part 96 and a lower part 98 that are connected via folding line 100. Front surface 94 is provided with a notch or groove capable of forming a lock in a closed position of hybrid pack 74.

Figure 8:
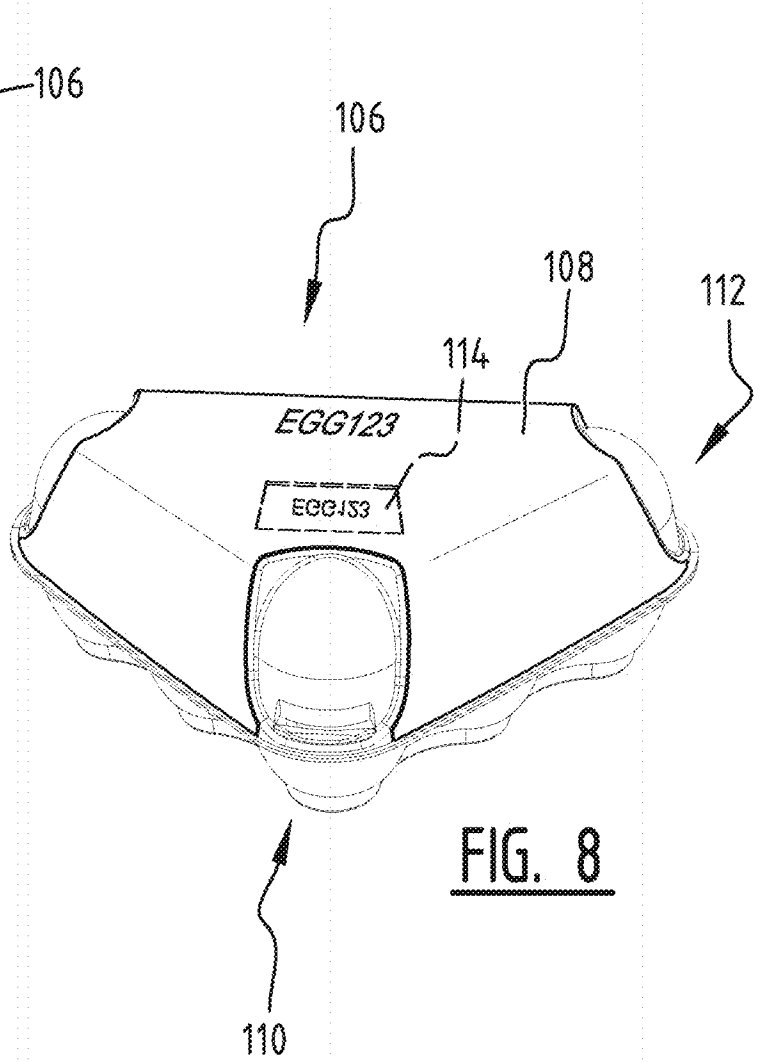
FIG. 6-8 show a triangular packaging unit.
Figure 6:
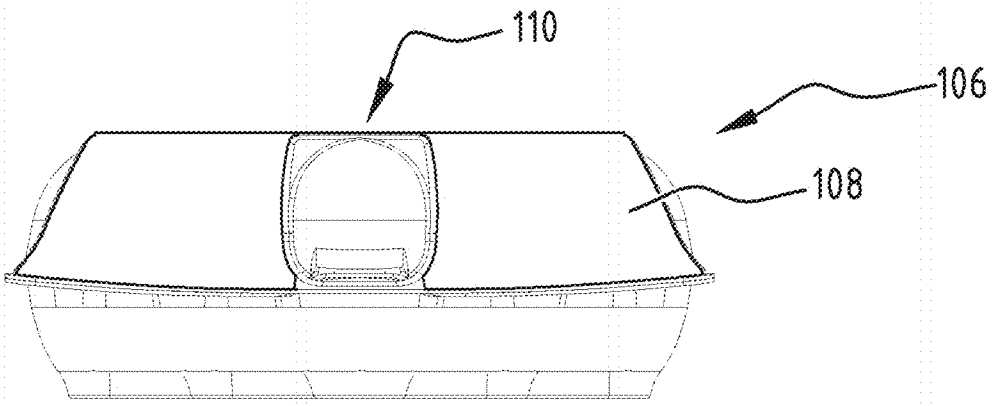
Figure 7:
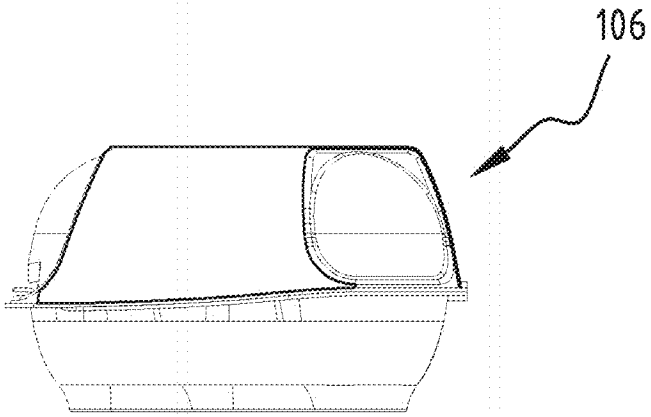

A triangular shaped packaging unit 106 (FIG. 6-8) is provided with a label 108, an egg-shaped indent 110, and an opening 114 in cover part 112. Unit 106 can be combined with one or more of the features described and illustrated for the rectangular shaped unit 2, thereby achieving most of the above described advantages in relation to the packaging unit according to the present invention.

Figure 9:
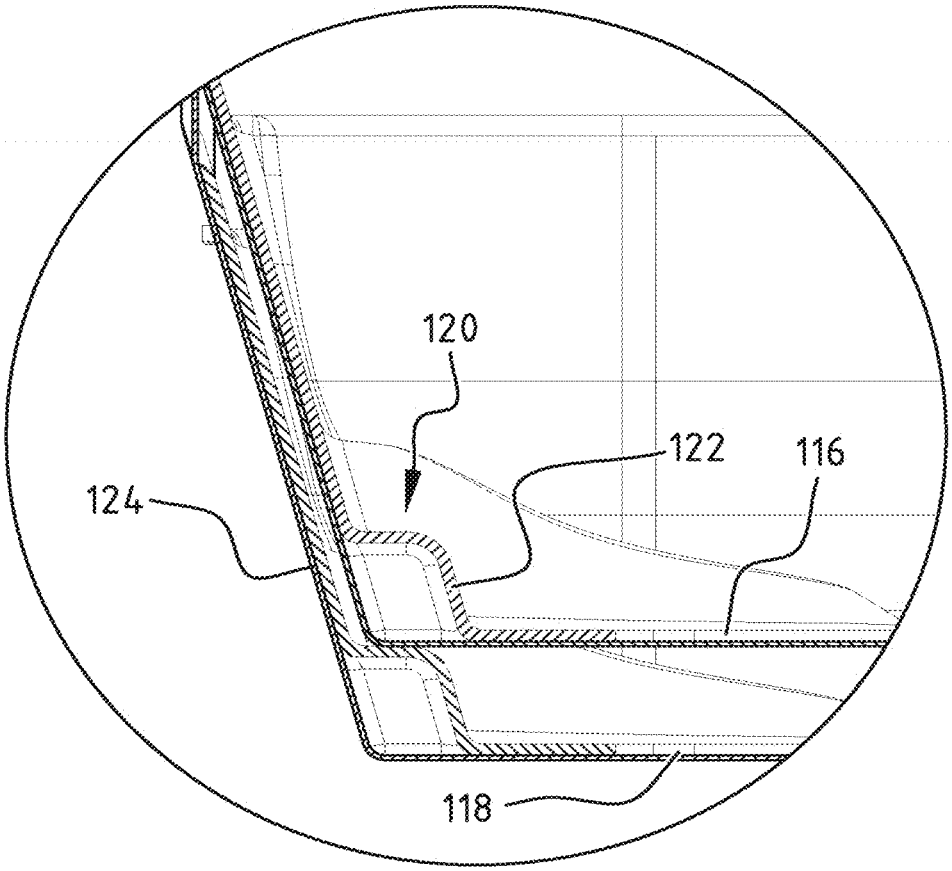
FIG. 9 shows a denest nock.

For denesting a first packaging unit 116 from another packaging unit 118 (FIG. 9) denesting nocks 120 are provided. In the illustrated embodiment nocks 120 are shaped as indents 122 in the moulded fiber material with the label 124 extending over indent 122. Preferably, label 124 covers indent 122 on the outside of packaging units 116, 118. In the illustrated embodiment the stacking height is in the range of 7-7.5 mm. This stacking height essentially is the distance between the covers of the packaging units 116 and 118.

The present invention is by no means limited to the above described preferred embodiments thereof. The rights sought are defined by the following claims, within the scope of which many modifications are possible. It is thus possible for instance to apply one or more of the features described in relation to the present invention in conventional packaging units. As an example, it is possible to use the egg-shaped indent in conventional packaging units without the use of the label according to the present invention.

The invention claimed is:

1. A packaging unit comprising:

a carton made of moulded pulp with a bottom part comprising compartments for individual products, and a cover part comprising top, front and rear surfaces, wherein the cover part is hingedly connected to the bottom part; and a label made of paperboard, the label comprising an extended front surface extending over the front surface of the cover part, the extended front surface comprising a groove, opening, or notch corresponding to a projection provided on the bottom part, the projection being configured to extend through the groove, opening, or notch such that a lock can be achieved between the label and the projection.

2. The packaging unit according to claim 1, wherein the paperboard comprises folding carton.

3. The packaging according to claim 1, wherein the label is attached to at least a top surface of the cover part.

4. The packaging unit according to claim 3, wherein the cover part comprises one or more openings such that a back side of the label is visible from an inside of the cover part.

5. The packaging unit according to claim 1, wherein the cover part comprises an indent such that a front surface of the packaging unit is supported.

6. The packaging unit according to claim 5, wherein the indent is egg-shaped.

7. The packaging unit according to claim 1, wherein the extended front surface of the label comprises a folding line.

8. The packaging unit according to claim 1, wherein the top surface of the cover part comprises enforcing ribs.

9. The packaging unit according to claim 8, wherein the enforcing ribs are provided on a location of the cover part such that the ribs engage support cones of the bottom part in a closed position of the packaging unit.

10. The packaging unit according to claim 8, wherein at least part of the enforcing ribs is formed by a label part.

11. The packaging unit according to claim 1, wherein the cover part comprises denest nocks.

12. A mould for a packaging unit according to claim 1.

13. A method for packing products, comprising a step of providing a packaging unit according to claim 1.

14. The packaging unit according to claim 1, wherein the label has a thickness greater than 0.25 mm.

15. The packaging unit according to claim 1, wherein the label has a thickness greater than 0.3 mm.

16. The packaging unit according to claim 2, wherein the weight of the folding carton is greater than 200 $g/m^2$ and less than 600 $g/m^2$.

17. The packaging unit according to claim 1, wherein the paperboard has a weight per surface area greater than 179 $g/m^2$.

18. The packaging unit according to claim 1, wherein the paperboard has a weight per surface area greater than 250 $g/m^2$.

19. The packaging unit according to claim 5, wherein the indent is positioned on an edge where the top surface and the front surface of the cover part meet each other.

20. The packaging unit according to claim 1, wherein the extending front surface of label comprises a folding line such a portion of the extending front surface is flexible about the folding line.

21. The packaging unit according to claim 1, wherein the extending front surface extends over at least a portion of a front surface of the bottom part.

22. The packaging unit according to claim 1, wherein the projection extends outward of the front surface of the cover part.

* * * * *